US005615433A

United States Patent [19]

Martin

[11] Patent Number: 5,615,433

[45] Date of Patent: Apr. 1, 1997

[54] COMBINATION DIAPER BAG AND PORTABLE CHANGING TABLE HAVING INLET AIR FLOW

[76] Inventor: David Martin, 5340 Beech St., Plano, Tex. 75093

[21] Appl. No.: 554,845

[22] Filed: Nov. 7, 1995

[51] Int. Cl.[6] ..... A47D 3/00; A47K 13/06

[52] U.S. Cl. ..... 5/655; 5/423; 5/657; 5/726

[58] Field of Search ..... 5/423, 424, 655, 5/657, 726; 190/1, 2

[56] References Cited

U.S. PATENT DOCUMENTS

| | | | |
|---|---|---|---|
| 2,400,790 | 5/1946 | Tolen | 5/286 |
| 2,609,073 | 9/1952 | McLaughlin | 190/11 |
| 3,101,488 | 8/1963 | Peebles | 5/347 |
| 3,489,194 | 1/1970 | Hoover | 150/1 |
| 3,721,434 | 3/1973 | Spies | 269/328 |
| 3,866,612 | 2/1975 | Buker | 5/423 |
| 3,943,583 | 3/1976 | Ishikawa | 5/695 |
| 4,052,179 | 10/1977 | Kirk | 55/385 G |
| 4,096,594 | 6/1978 | St. Jean | 5/695 |
| 4,190,918 | 3/1980 | Harvell | 5/657 |
| 4,206,524 | 6/1980 | Cook | 5/468 |
| 4,305,168 | 12/1981 | Holter et al. | 5/512 |
| 4,527,830 | 7/1985 | Meyers | 297/192 |
| 4,781,277 | 11/1988 | Lim | 190/1 |
| 4,792,024 | 12/1988 | Morton et al. | 190/1 |
| 4,886,150 | 12/1989 | Fitzsimmons | 190/1 |
| 4,981,324 | 1/1991 | Law | 5/423 |
| 5,215,172 | 6/1993 | Stevenson | 190/2 |
| 5,230,720 | 7/1993 | Kendall | 55/210 |
| 5,265,289 | 11/1993 | Swiger et al. | 5/111 |
| 5,439,154 | 8/1995 | Delligatti | 224/205 |

*Primary Examiner*—Steven N. Meyers
*Assistant Examiner*—Robert G. Santos
*Attorney, Agent, or Firm*—Harris, Tucker & Hardin, P.C.

[57] ABSTRACT

A combination diaper bag and portable changing table provides convenient transport of infant care supplies and a place to change an infant's diaper which draws, filters, and then exhausts air from above the changing table. In a preferred embodiment, an infant care device has an enclosure, a lid pivotably attached to the enclosure, a generally planar platform which extends laterally across the enclosure, a generally planar foldable pad having a centrally disposed opening formed therethrough, and a fan which draws air from above the pad through its central opening.

11 Claims, 3 Drawing Sheets

COMBINATION DIAPER BAG AND PORTABLE CHANGING TABLE HAVING INLET AIR FLOW

BACKGROUND OF THE INVENTION

The present invention relates generally to infant care products and, in a preferred embodiment thereof, more particularly provides a portable diaper bag and changing table.

When away from home, a parent or other adult is frequently accompanied by an infant in diapers. Also quite frequently, the infant's diaper must be changed while away from home, in surroundings that are not equipped with infant care products. For this reason, most adults having care of an infant while away from home carry such infant care products with them in a diaper bag.

Diaper bags are typically fabric bags having various openings and enclosures therein for storage of infant care products, such as baby powder, tissues, baby formula, diapers, etc. Of course, as the amount of storage space in a diaper bag increases, its portability decreases. Thus, in designing diaper bags, a designer must strive to strike a balance between quantity of items transported and convenience of transport. In this regard, for commercial success, a diaper bag design must be "efficient".

Most diaper bags are designed primarily to store and transport consumables, that is, the baby care products which are consumed in caring for the infant while away from home. Some, however, are large enough to also carry a change of clothes, toys, etc. for the infant. Furthermore, some diaper bags are even large enough to store a rolled-up or folded pad for laying the infant on while changing the infant's diaper.

A number of diaper bags have built-in, or integral, diaper changing pads. Representative of these are the diaper bags found in U.S. Pat No. 5,265,289 to Swiger et al., U.S. Pat. No. 5,215,172 to Stevenson, U.S. Pat. No. 4,886,150 to Fitzsimmons, U.S. Pat. No. 4,792,024 to Morton et al., U.S. Pat. No. 4,781,277 to Lim, U.S. Pat. No. 4,527,830 to Meyers, U.S. Pat. No. 3,489,194 to Hoover, U.S. Pat. No. 2,609,073 to McLaughlin, and U.S. Pat. No. 5,439,154 to Delligatti. Each of these attempt to enhance the convenience of the diaper bag by providing a platform and/or pad on which the adult may place the infant while changing the infant's diaper.

The above-mentioned diaper bags do not, however, solve all problems associated with changing an infant's diaper. For example, one problem not solved by the above diaper bags is the problem of unpleasant odors which escape when an infant's soiled diaper is removed. Heretofore, the person changing the infant's diaper has had to endure these unpleasant odors while changing the infant's diaper, and, if other persons are present, has had to endure some embarrassment caused by the other persons being exposed to the unpleasant odors.

While it is known in the art to ventilate mattresses and pads (see, for example, U.S. Pat. No. 2,400,790 to Tolen, U.S. Pat. No. 3,101,488 to Peebles, U.S. Pat. No. 4,305,168 to Holter et al., and U.S. Pat. No. 4,206,524 to Cook), applicant is unaware of any device in the art which draws air from above an infant changing pad, removes the unpleasant odors, and then exhausts the air. Applicant is likewise unaware of any such device in the art which is specially adapted for ease of transport with other infant care products.

Another problem which has heretofore gone unsolved is that of male and/or female infants urinating while their diaper is being changed. This occurs quite frequently, particularly for male infants, and is unpleasant and embarassing for the person changing the infant's diaper.

From the foregoing, it can be seen that it would be quite desirable to provide an efficiently designed combined diaper bag and portable changing table which is conveniently transportable, and which removes unpleasant odors inherent in the diaper changing process. It is accordingly an object of the present invention to provide such a combination diaper bag and portable changing table.

SUMMARY OF THE INVENTION

In carrying out the principles of the present invention, in accordance with an embodiment thereof, a combined diaper bag and infant diaper changing table is provided which draws, filters, and then exhausts air from above the changing table.

In broad terms, an infant care device is provided which includes an enclosure having a bottom side, a plurality of vertical sides and an upwardly facing opening, a lid having a bottom side surface, the lid being pivotably attached to one of the enclosure vertical sides and further being pivotable between a first closed configuration wherein the lid extends laterally across the enclosure opening, and a second open configuration wherein the lid is horizontally disposed and extends laterally and outwardly away from one of the enclosure vertical sides, a generally planar platform having top and bottom side surfaces and an opening formed therethrough, the platform further having a first closed position wherein the platform extends laterally across the enclosure opening, a generally planar foldable pad having top and bottom side surfaces and a centrally disposed opening formed therethrough, the pad further having a first folded position wherein the pad is folded between the lid and the platform when the lid is in its closed configuration, and a second unfolded position wherein the pad laterally extends overlying the lid bottom side and the platform top side surface when the lid is in its open configuration, and a fan disposed beneath the platform bottom side surface, the fan drawing air from above the pad top side surface, through the pad opening and the platform opening, and into the enclosure.

An apparatus for supporting an infant while the infant's diaper is being changed is also provided, the apparatus including generally planar horizontal support means for supporting the infant, the support means having a length, a width, a center portion, and first and second support portions, the center portion being disposed midway along the length and midway along the width, the first and second portions being pivotably attached to each other, a first opening formed vertically through the horizontal support means, the opening being disposed approximately on the center portion, means for drawing air from above the support means and through the first opening, and means for filtering air drawn from above the support means by the drawing means, the filter means being disposed intermediate the first opening and the drawing means.

Additionally, an odor control device for an infant is provided, the odor control device including a generally planar horizontal pad upon which the infant may be laid, the pad having a first opening formed therethrough at a location which is generally beneath the infant's pelvic region when the infant is laid upon the pad, the pad further having a bottom side surface, an enclosure having exterior and interior side surfaces and an upwardly facing second opening, the enclosure being attached to the pad such that the second opening is in fluid communication with the first opening, air moving means for drawing air from above the pad, through the first and second openings, and a third opening providing fluid communication between the second opening and the enclosure exterior side surface.

The use of the disclosed combination diaper bag and changing table eliminates some unpleasant aspects of the diaper changing process and accomplishes this objective in an efficient, convenient, and portable package. The disclosed device has the additional benefit of reducing the frequency of infants urinating while their diapers are being changed.

DETAILED DESCRIPTION

Figure 1:
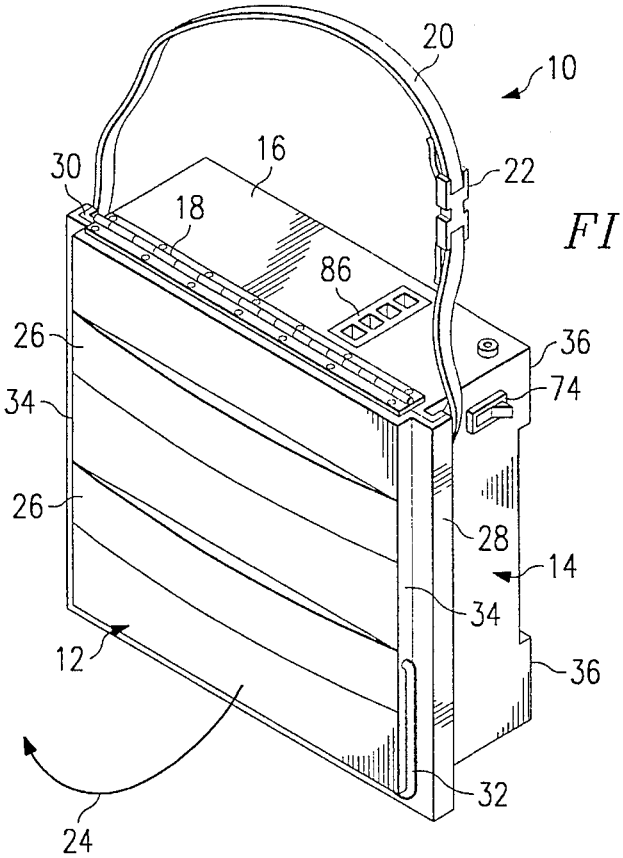
FIG. 1 is a perspective view of an infant care device embodying principles of the present invention.

Illustrated in FIG. 1 is an infant care device 10 which embodies principles of the present invention. The infant care device 10, shown in a closed configuration, includes a lid portion 12 and an enclosure portion 14. The lid portion 12 is pivotably attached to a side surface 16 of the enclosure portion 14 with a hinge 18, representatively illustrated as a conventional elongated piano hinge. The hinge 18 permits the lid 12 to pivot away from the enclosure portion 14 in the direction indicated by arrow 24.

A carrying strap 20, including a conventional adjustable buckle 22, is fastened to the enclosure portion 14 as further described hereinbelow and permits the device 10 to be conveniently carried about by a user. The buckle 22 is also releasable, allowing the strap 20 to be stored inside the device 10. Such storage of the strap 20 is of benefit when, for example, the device 10 is checked as baggage on an airplane.

Lid 12 has lateral stiffening members 26 integrally formed thereon. The stiffening members 26 prevent bending and buckling of the lid 12. Lid 12 also has a generally L-shaped peripheral edge 28 which overlaps a complimentarily shaped peripheral edge 30 formed on the enclosure portion 14.

A laterally extending, generally U-shaped support leg 32 is pivotably mounted to the lid 12 at opposite side portions 34 formed adjacent the peripheral edge 28. The function of the support leg 32 will be apparent upon consideration of FIG. 2 and accompanying written description below. Note that, as representatively illustrated in FIG. 1, the support leg 32 is foldable so that it lies flat against the lid 12 in a stowed position.

Figure 2:
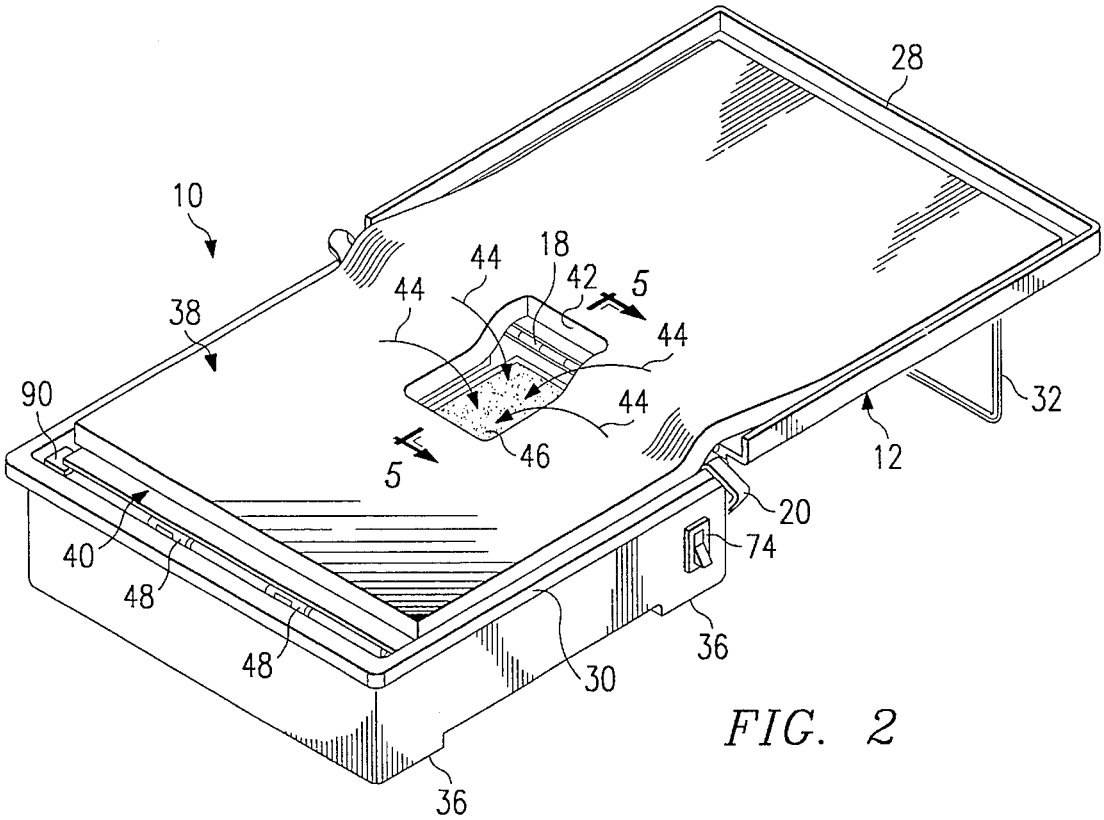
FIG. 2 is a perspective view of the infant care device of FIG. 1, in an open configuration thereof.

Turning now to FIG. 2, the infant care device 10 is shown with the lid 12 pivoted away from the enclosure 14 in an opened configuration of the device 10. The enclosure 14 is horizontal, lying flat on bottom side surfaces 36, and the lid 12 is pivoted away from the enclosure 14 such that the lid 12 is also horizontal.

Lid 12 is supported by the hinge 18 and by the support leg 32. The support leg 32 has been pivoted so that it is now generally perpendicular to the lid 12 and is capable of supporting the lid 12 horizontally and at a distance from the enclosure 14.

In the representatively illustrated open configuration of the device 10, the generally horizontal enclosure 14 and lid 12 together form a platform on which an infant may be laid. A generally rectangular foldable pad 38, which is folded between the lid 12 and enclosure 14 when the device 10 is in its closed configuration (see FIG. 1), overlies the platform formed by the lid 12 and enclosure 14. The pad 38 is made of a soft material for the comfort of the infant and may alternatively have a liquid impervious covering. At one end, overlying the enclosure 14, the pad 38 is secured to a platform portion 40. At an opposite end, overlying the lid 12, the pad 38 is laterally contained within the peripheral edge 28.

The pad 38 includes a specially configured and centrally located opening 42. The opening 42 is disposed on the pad 38 generally where an infant's pelvic region is located when the infant is lying on the pad 38. A forced ventilation system more fully described hereinbelow draws air, representatively illustrated by arrows 44, downwardly through the opening 42 and into a filter 46.

Thus, any unpleasant odors in the air above the pad 38 will be drawn downwardly through the opening 42 when the infant is lying on the pad 38 and the forced ventilation system is activated. Applicant has also determined through testing that such air flow across the pelvic region of an infant is effective in preventing the infant from urinating while his or her diaper is being changed.

Figures 3, 4:
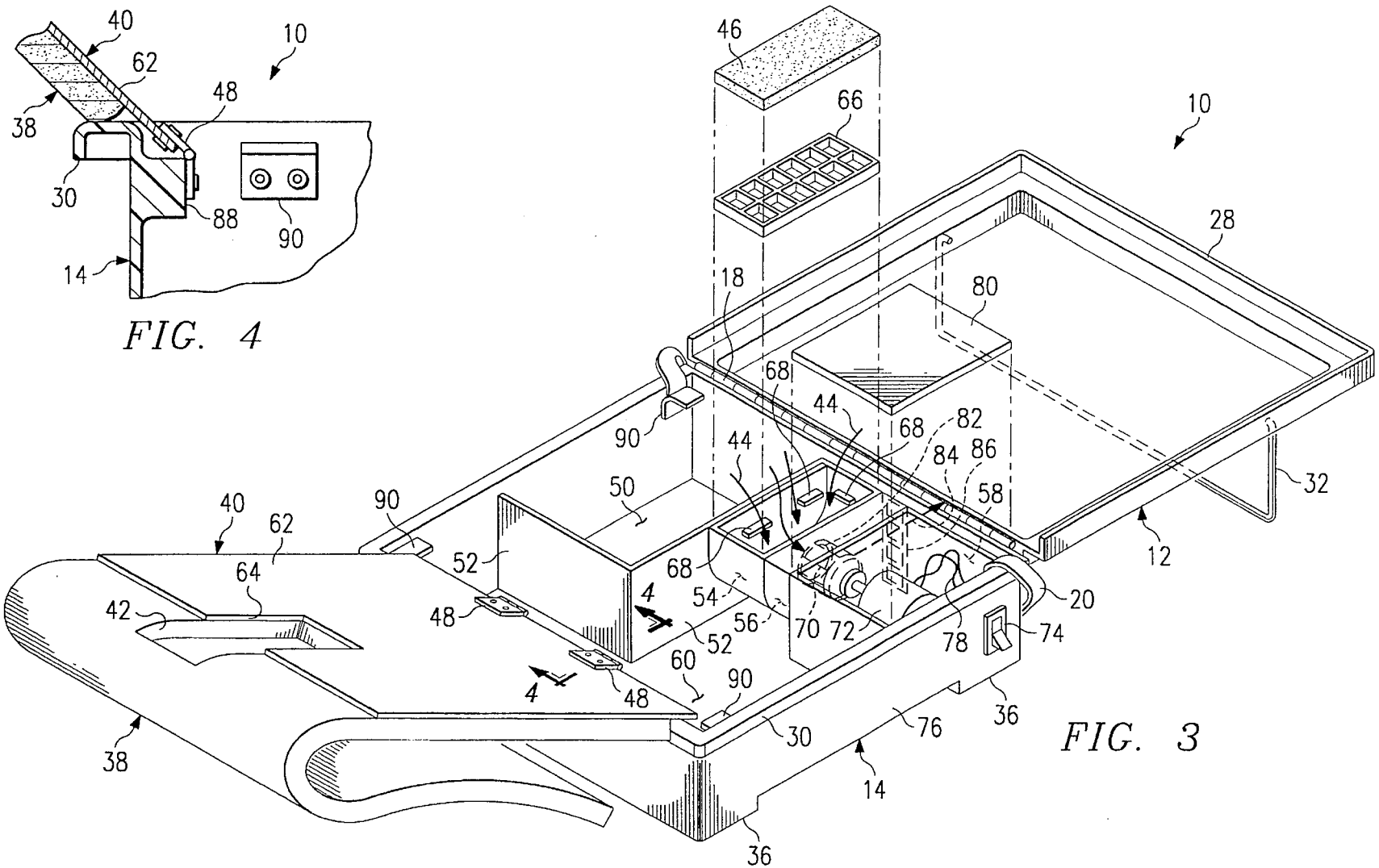
FIG. 3 is a perspective exploded view of the infant care device, with a platform portion thereof in an open position, illustrating various compartments within an enclosure portion of the infant care device.
FIG. 4 is an enlarged cross-sectional view of a platform hinge portion of the infant care device, taken along line 4—4 of FIG. 3.

Turning now to FIG. 3, the device 10 is shown in its open configuration with the platform portion 40 pivoted away from the enclosure 14, the platform portion 40 being pivotably mounted to the enclosure 14 by hinges 48. In this view it can be seen that the enclosure 14 contains several compartments including, representatively, a generally rectangular compartment 50 formed within the enclosure 14 by generally vertical walls 52, a filter compartment 54, a fan compartment 56, a motor compartment 58, and a compartment 60 which includes the interior of the enclosure 14 not otherwise utilized. Applicant prefers that, in the illustrated preferred embodiment, the compartment 50 is shaped to accommodate standard-sized baby bottles, and that compartment 60 is shaped to accommodate standard-sized baby diapers, although other compartments (of different sizes, shapes, quantities, etc.) may be provided without departing from the principles of the present invention.

Note that, when the platform portion 40 is positioned horizontally adjacent and overlying the enclosure 14, as shown in FIG. 2, various compartments 50, 56, and 58 are covered by the platform portion's bottom side 62, but the filter compartment 54 is not covered. This is because opening 42 in the pad 38 and corresponding opening 64 in the platform opening 40 overlie the filter compartment 54. Note, also, that the filter 46 is contained in the filter compartment 54 between the platform portion bottom side 62 and a grille 66. The grille 66 is, in turn, supported in the filter compartment 54 on inwardly extending tabs 68.

Fan compartment 56 contains a conventional squirrel cage-type fan 70 which is driven by a conventional electric motor 72 located in the motor compartment 58. The motor 72 is controlled by switch 74 mounted on a side portion 76 of the enclosure 14 and electrically connected to the motor 72 with wires 78. A cover 80 separates the motor compartment 58 from the rest of the enclosure 14. Applicant prefers that the motor 72 is powered, in the illustrated preferred embodiment, by batteries (not shown) to facilitate use of the device 10 in locations where electrical outlets are unavailable, but it is to be understood that the motor 72 may be otherwise powered, for example, by plugging into a conventional electrical outlet, without departing from the principles of the present invention.

The fan 70 draws air from the filter compartment 54 into the fan compartment 56 through an opening 82 extending therebetween. The air is then exhausted from the fan compartment 56, as represented by arrow 84, through a grille 86. The grille 86 provides a ventilation path between the fan compartment 56 and the environment external to the enclosure 14.

Illustrated in FIG. 4 is a partial cross-sectional view of the device 10 taken adjacent one of the hinges 48 which pivotably secure the platform portion 40 to the enclosure 14. Hinge 48 is fastened between the platform portion 40 at its bottom side 62 and a laterally and inwardly extending projection 88. When opened, as representatively illustrated in FIG. 4, the platform portion 40 and pad 38 may rest against the peripheral edge 30 of the enclosure 14. When closed (see FIG. 2), the platform portion bottom side 62 rests on four tabs 90 fastened to inner side surfaces of the enclosure 14.

Two of the tabs 90 also secure the strap 20 to the enclosure 14 (see FIG. 3). Securing the strap 20 to the interior of the enclosure 14 in this manner permits the strap 20 to be easily stored inside the device 10. Starting with the device 10 in its closed configuration (see FIG. 1), storage of the strap 20 is accomplished by releasing the buckle 22 (see FIG. 1), opening the lid 12 (see FIG. 2), placing the strap 20 ends inside the device 10, and closing the lid 12.

Figure 5:
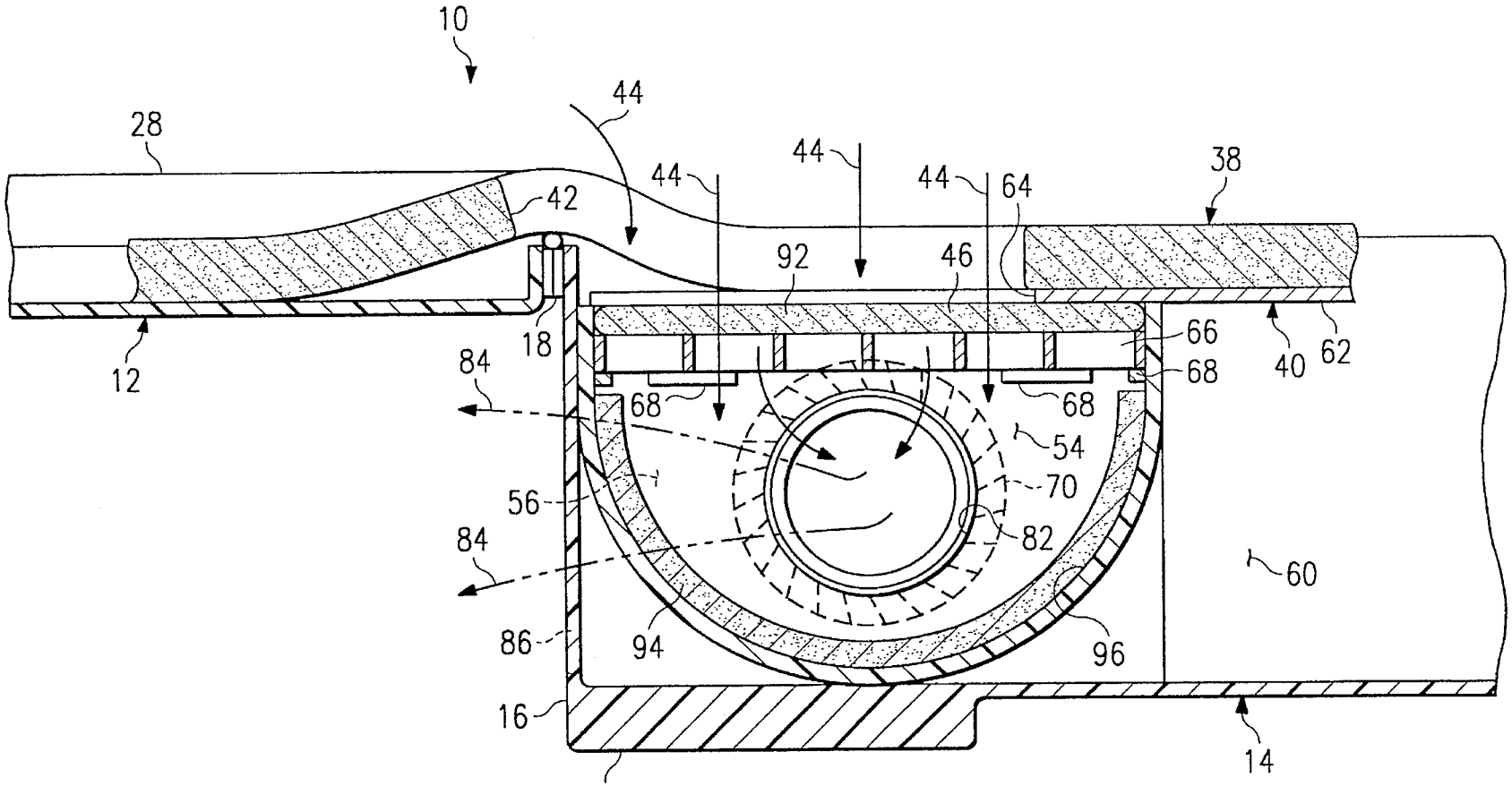
FIG. 5 is an enlarged cross-sectional view of a filter compartment portion of the infant care device, taken along line 5—5 of FIG. 3.

FIG. 5 shows a cross-sectional view of the device 10, taken through the filter compartment 54. In this view, the manner in which air is drawn from above the pad 38, filtered, deodorized, and exhausted may be clearly seen.

The air (represented by arrows 44) enters the opening 42 in the pad 38, passes through the opening 64 in the platform portion 40, and enters the filter compartment 54 in the enclosure 14. In the filter compartment 54, the air passes through the filter 46, which may be scented and/or deodorized by applying a fragrance and/or deodorant to the filter material 92, and then through the grille 66. The filter material 92 is preferably charcoal, which is effective for removing odors from the air 44, although other filter materials may be used without departing from the principles of the present invention.

The air is then drawn through the opening 82 leading to the fan compartment 56 by the fan 70. Once in the fan compartment 56, the air (represented by arrows 84) is exhausted through the grille 86 installed through side 16 of the enclosure 14.

In this view the manner in which the filter 46 is sandwiched between the platform portion 40 bottom side 62 and the grille 66 may also be clearly seen.

Beneath the grille 66, and mounted to a curved interior bottom side surface 96 of the filter compartment 54 is a deodorizing pad 94. The pad 94 preferably has a deodorant applied to it and functions to eliminate any odors that may remain in the air 44 after it passes through the filter 46. Pad 94 may also be made of an absorbent material so that it will absorb any liquids that may fall through openings 42 and 64.

Pad 94 is preferably mounted to surface 96 of the filter compartment 54 with an adhesive (not shown), but other methods of mounting the pad 94 may be used. Note that tabs 68 not only support the grille 66, but may also maintain the absorbent pad 94 against bottom surface 96 if an adhesive is not used to mount the pad 94 to the bottom surface 96. Thus, if an adhesive is not used, or if a releasable adhesive is used, the pad 94 may be easily replaced by opening the platform portion 40 (see FIG. 3), removing the filter 46, removing the grille 66, removing the pad 94, installing a new pad 94, replacing the grille 66 and filter 46, and closing the platform portion 40. Pad 94 may also be scented as described above in regard to the filter 46.

Note that, with the device 10 in its representatively illustrated open configuration, the lid 12 and platform portion 40 both lie in approximately the same horizontal plane. The pad 38 is shown in FIG. 5 rising vertically to pass over the hinge 18 between the lid 12 and platform portion 40, but it is to be understood that the hinge 18 (and corresponding portions of the lid 12 and enclosure 14 to which the hinge 18 is fastened) may be moved vertically downward as viewed in FIG. 5, or otherwise relocated, such that the pad 38 does not rise vertically between the platform portion 40 and lid 12, without departing from the principles of the present invention.

The foregoing detailed description is to be clearly understood as being given by way of illustration and example only, the spirit and scope of the present invention being limited solely by the appended claims.

What is claimed is:

1. Infant care device, comprising:

an enclosure having a plurality of generally vertical sides and an upwardly facing opening;

a lid having a bottom side surface, said lid being pivotably attached to one of said enclosure vertical sides and further being pivotable between a first closed configuration wherein said lid extends laterally across said enclosure opening, and a second open configuration wherein said lid is horizontally disposed and extends laterally and outwardly away from said one of said enclosure vertical sides;

a generally planar platform having top and bottom side surfaces and an opening formed therethrough, said platform further having a first closed position wherein said platform extends laterally across said enclosure opening;

a generally planar foldable pad having top and bottom side surfaces and a centrally disposed opening formed therethrough, said pad further having a first folded position wherein said pad is folded between said lid and said platform when said lid is in said closed configuration thereof, and a second unfolded position wherein said pad laterally extends overlying said lid bottom side and said platform top side surface when said lid is in said open configuration thereof; and a fan disposed beneath said platform bottom side surface, said fan drawing air from above said pad top side surface, through said pad opening and said platform opening, and into said enclosure.

2. The device according to claim 1, wherein said enclosure further includes first and second compartments, said fan being disposed in said first compartment, and further comprising an exhaust opening formed through said enclosure, said exhaust opening providing ventilation between said first compartment and an exterior side surface of said enclosure, and an inlet opening, said inlet opening providing ventilation between said second compartment and said first compartment, said fan being configured to draw air from said second compartment to said first compartment through said inlet opening and force air from said second compartment through said exhaust opening.

3. The device according to claim 2, further comprising a filter disposed intermediate said platform opening and said second compartment.

4. The device according to claim 3, further comprising an absorbent pad disposed in said second compartment, and wherein said second compartment is disposed beneath said platform opening such that said absorbent pad is beneath said platform opening.

5. The device according to claim 3, further comprising a grille disposed in said second compartment intermediate said filter and said inlet opening, said grille supporting said filter in said second compartment and permitting air flow from said filter to said inlet opening.

6. The device according to claim 3, wherein said filter includes a fragrance for scenting air passing through said filter.

7. The device according to claim 3, wherein said filter includes a deodorant for removing odors from air passing through said filter.

8. The device according to claim 1, wherein said platform is pivotably attached to another of said enclosure vertical sides and is pivotable between said first closed position and a second open position wherein said platform extends outwardly away from said enclosure opening.

9. The device according to claim 1, wherein when said lid is in said second open configuration thereof and said platform is in said first closed position thereof, said lid bottom side and said platform top side surface are coplanar.

10. The device according to claim 1, wherein said pad bottom side surface is fixedly attached to said platform top side surface.

11. The device according to claim 1, further comprising a support leg pivotably attached to said lid, said support leg supporting said lid such that said lid is supported generally horizontally when said lid is in said second open configuration thereof.

* * * * *